US009997880B1

(12) United States Patent
Tseng et al.

(10) Patent No.: US 9,997,880 B1
(45) Date of Patent: Jun. 12, 2018

(54) ADAPTER DEVICE

(71) Applicant: Cheng Uei Precision Industry Co., Ltd., New Taipei (TW)

(72) Inventors: Chi-Ming Tseng, New Taipei (TW); Chin-Chung Lin, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days. days.

(21) Appl. No.: 15/668,696

(22) Filed: Aug. 3, 2017

(51) Int. Cl.
*H01R 25/00* (2006.01)
*H01R 27/02* (2006.01)
*H01R 31/06* (2006.01)

(52) U.S. Cl.
CPC ..... *H01R 27/02* (2013.01); *H01R 31/06* (2013.01)

(58) Field of Classification Search
CPC ..... H01R 27/00; H01R 27/02; H01R 31/00; H01R 31/005; H01R 31/06; H01R 31/065
USPC ..... 439/638, 639, 926
See application file for complete search history.

(56) References Cited

U.S. PATENT DOCUMENTS 5,748,443 A * 5/1998 Flint ..... G06F 1/183 361/679.32
8,043,122 B1 * 10/2011 Cho ..... H01R 31/005 439/501
8,419,479 B2 * 4/2013 Vroom ..... H01R 13/512 361/679.45
8,916,774 B2 * 12/2014 Richards ..... H02G 3/0487 174/70 C
9,531,145 B2 * 12/2016 Byrne ..... H01R 25/006

* cited by examiner

*Primary Examiner* — Khiem Nguyen
(74) *Attorney, Agent, or Firm* — Cheng-Ju Chiang

(57) ABSTRACT

An adapter device includes a base body, a fastening assembly and a circuit module. The base body opens a plurality of openings corresponding to a plurality of connection ports with different specifications. The fastening assembly is mounted to the base body. The circuit module is assembled to the base body. The circuit module includes a circuit board and at least one connecting cable. The circuit board is assembled in the base body. The circuit board is equipped with the plurality of the connection ports with the different specifications. The at least one connecting cable is received in the base body and the fastening assembly. One end of the at least one connecting cable is electrically connected with the circuit board. The other end of the at least one connecting cable is equipped with a plug docking with at least one insertion port of a tablet electronic device.

19 Claims, 15 Drawing Sheets

ADAPTER DEVICE

BACKGROUND OF THE INVENTION

1. Field of the Invention

The present invention generally relates to a device, and more particularly to an adapter device.

2. The Related Art

With the development of electronic sciences and technologies, tablet computers are more and more popular, in order to be applicable to different usage environments, more and more conditions of the tablet computers cooperating with other various electronic devices to be used are emerged.

Currently, the tablet computer is generally smaller and thinner, the tablet computer usually has one insertion port or two insertion ports. A transmission cable is capable of being connected between the tablet computer and each of the various electronic devices. One end of the transmission cable has a first port for docking with the insertion port of the tablet computer, and the other end of the transmission cable has a second port for docking with a docking port of each of the various electronic devices. Each of the various electronic devices is capable of cooperating with the tablet computer to be used. So data signals, power signals or audio signals are capable of being connected and transmitted between the insertion port of the tablet computer and the docking port of each of the various electronic devices by virtue of the transmission cable.

However, the various electronic devices which are capable of cooperating with the tablet computer to be used have different docking ports with different specifications, if different transmission cables of which the second ports have different specifications are just applied to dock with the different docking ports of the various electronic devices, so a large number of the different transmission cables need be prepared that causes an inconvenience in use.

Thus, in order to solve the problem described above, an innovative adapter device need be provided, the various electronic devices which are capable of cooperating with the tablet computer are electrically connected with the tablet computer by virtue of the innovative adapter device being connected between the insertion port and the different docking ports, so the tablet computer is appropriate for being applied in various usage environments for satisfying multiple usage needs of users.

SUMMARY OF THE INVENTION

An object of the present invention is to provide an adapter device for receiving a tablet electronic device in the adapter device. The adapter device has a plurality of connection ports with different specifications. The tablet electronic device is equipped with at least one insertion port. The adapter device converts the at least one insertion port into the plurality of the connection ports with the different specifications. The adapter device includes a base body, a fastening assembly and a circuit module. The base body opens a plurality of openings communicated with an inside of the base body and an outside of the base body. The plurality of the openings are corresponding to the plurality of the connection ports with the different specifications. The inside of the base body defines an accommodating space communicated with the plurality of the openings. The fastening assembly is mounted to the base body. The fastening assembly opens a receiving space penetrating through a middle of a front surface of the fastening assembly. The tablet electronic device is assembled in the receiving space.

The circuit module is assembled to the base body. The circuit module includes a circuit board and at least one connecting cable. The circuit board is assembled in the accommodating space of the base body. The circuit board is equipped with the plurality of the connection ports with the different specifications. The plurality of the connection ports are exposed from the plurality of the openings. The at least one connecting cable passes through connecting ends of the base body and the fastening assembly, and the at least one connecting cable is received in the accommodating space of the base body and the receiving space of the fastening assembly. One end of the at least one connecting cable is electrically connected with the circuit board. The other end of the at least one connecting cable is equipped with a plug docking with the at least one insertion port of the tablet electronic device.

As described above, the circuit board is equipped with the plurality of the connection ports with the different specifications, the one end of the at least one connecting cable is electrically connected with the circuit board, and the other end of the at least one connecting cable is equipped with the plug docking with the at least one insertion port of the tablet electronic device, the connection ports with the different specifications are capable of being connected with different docking ports of various electronic devices which have different specifications, and the various electronic devices are electrically connected with the tablet electronic device by virtue of the adapter device being connected between the at least one insertion port of the tablet electronic device and the different docking ports of the various electronic devices, so the tablet electronic device is appropriate for being applied in various usage environments for satisfying multiple usage needs of users. Furthermore, no transmission cable is applied to dock with the different docking ports of the various electronic devices, so no transmission cable need be prepared to bring a convenience in use.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
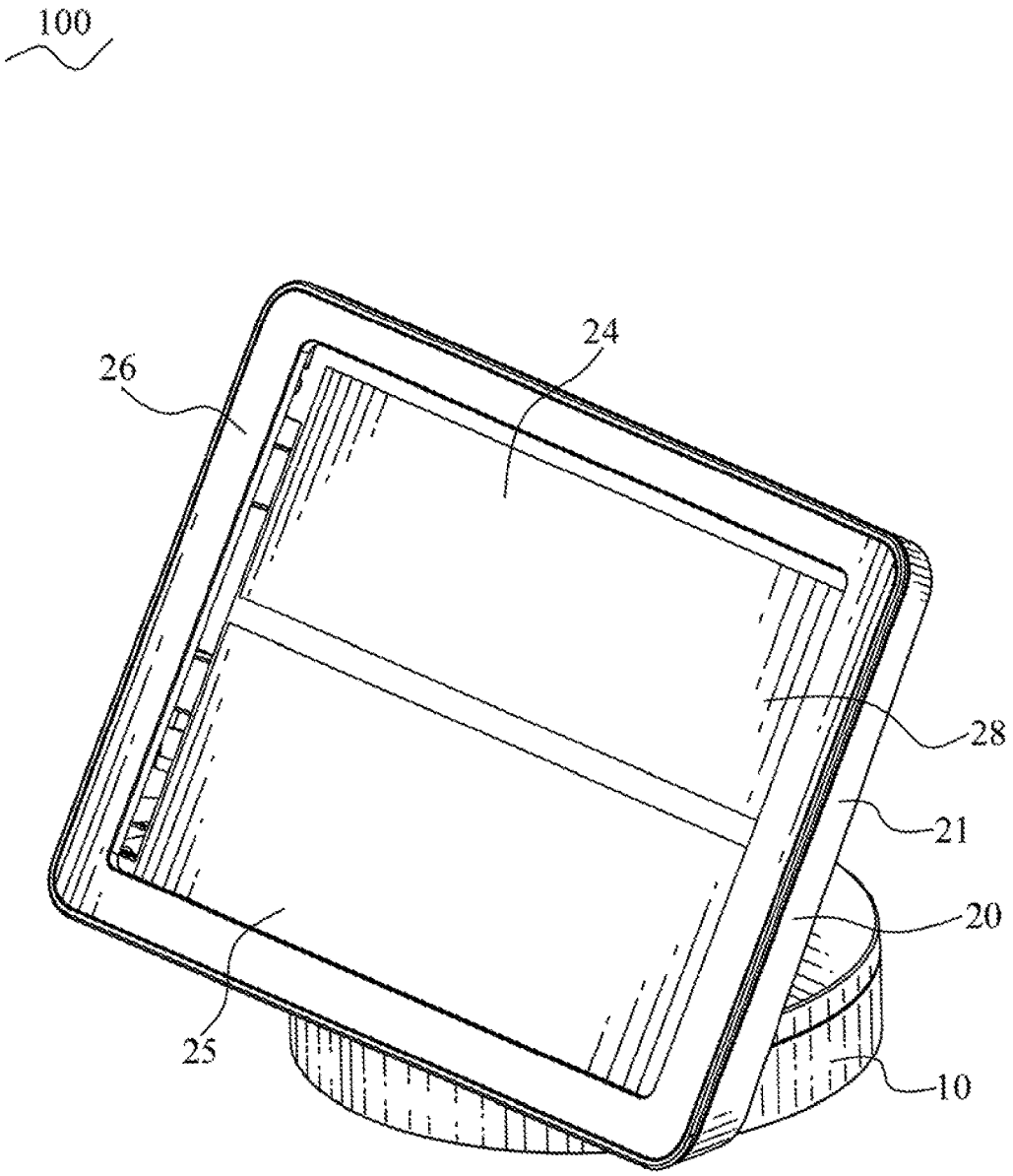
FIG. 1 is a perspective view of an adapter device in accordance with a preferred embodiment of the present invention.

With reference to FIG. 1 to FIG. 6, an adapter device 100 in accordance with a preferred embodiment of the present invention is shown. The adapter device 100 for receiving a tablet electronic device 200 in a receiving space 220 of the adapter device 100, includes a base body 10, a fastening assembly 20 mounted to the base body 10, and a circuit module 40 assembled to the base body 10. The adapter device 100 has a plurality of connection ports 42 with different specifications. The tablet electronic device 200 is equipped with at least one insertion port 201 and a power switch 202. The adapter device 100 converts the at least one insertion port 201 into the plurality of the connection ports 42 with the different specifications. The circuit module 40 includes a circuit board 41 and at least one connecting cable 30. The adapter device 100 is applicable for being connected between various electronic devices (not shown) and the tablet electronic device 200. Each of the various electronic devices is capable of cooperating with the tablet electronic device 200 to be used.

Figure 2:
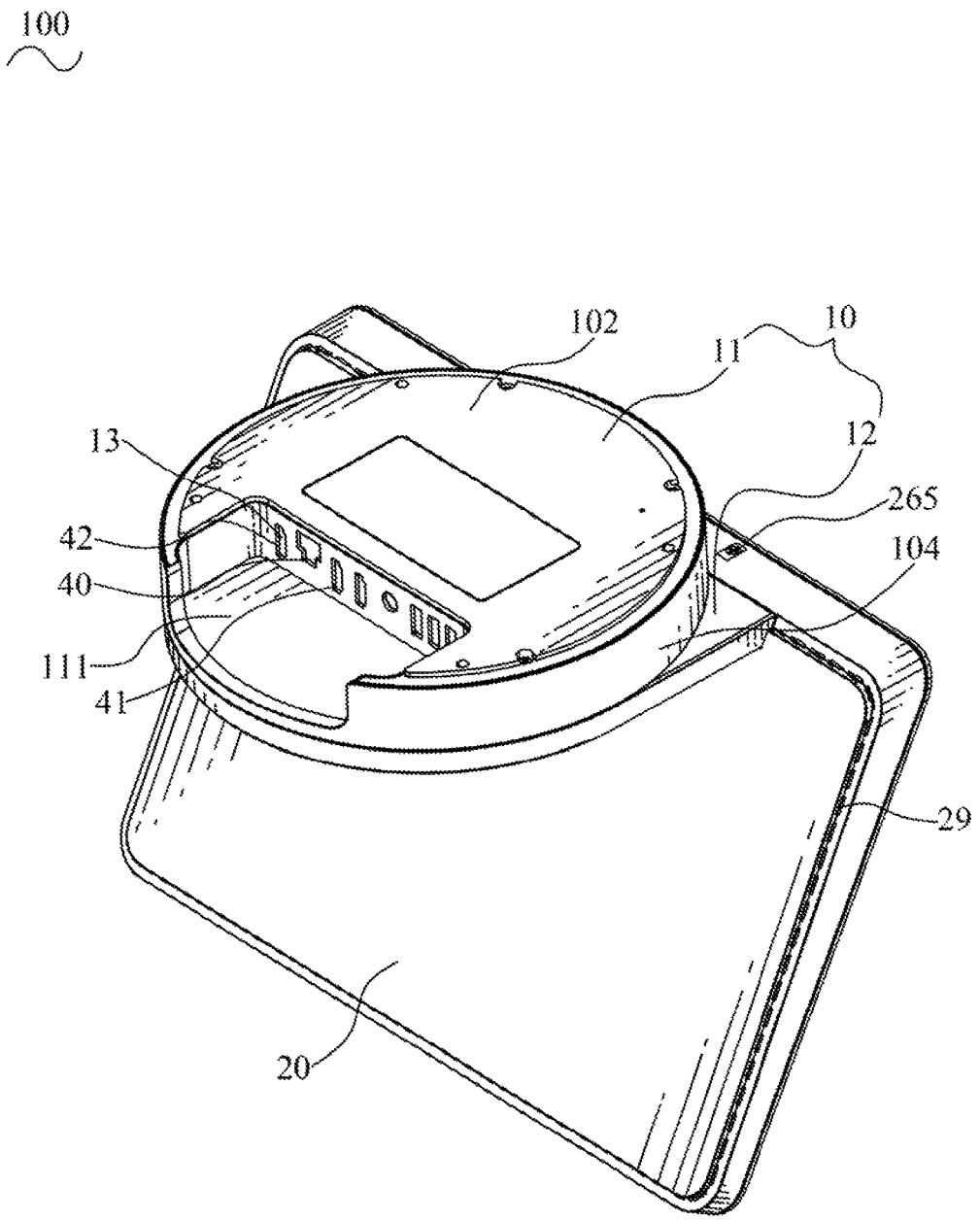
FIG. 2 is a perspective diagrammatic drawing of the adapter device of FIG. 1.
Figure 3:
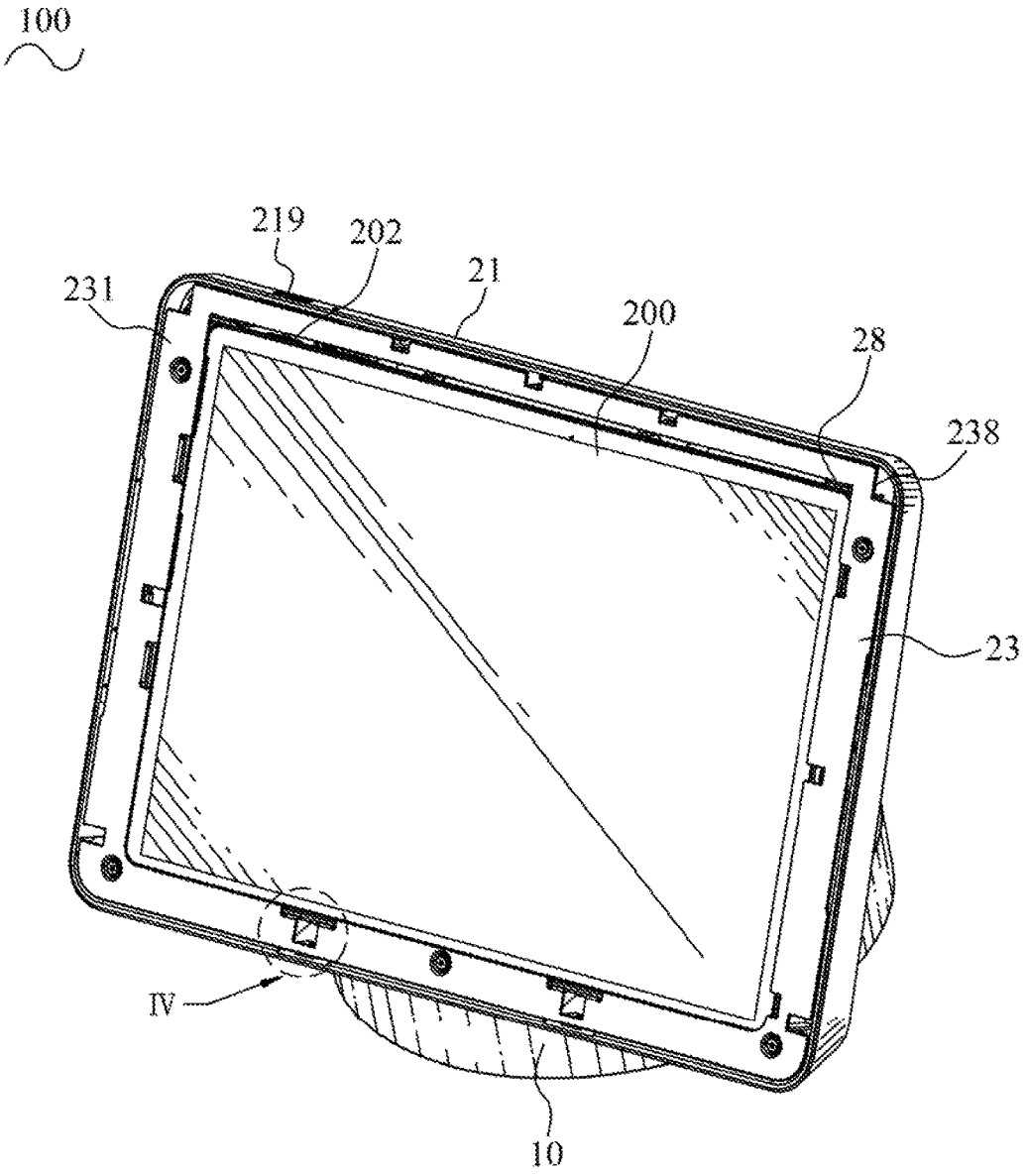
FIG. 3 is a partially perspective view of the adapter device of FIG. 1, wherein a tablet electronic device is assembled in a front receiving space of the adapter device, and a front cover of the adapter device is omitted.
Figure 4:
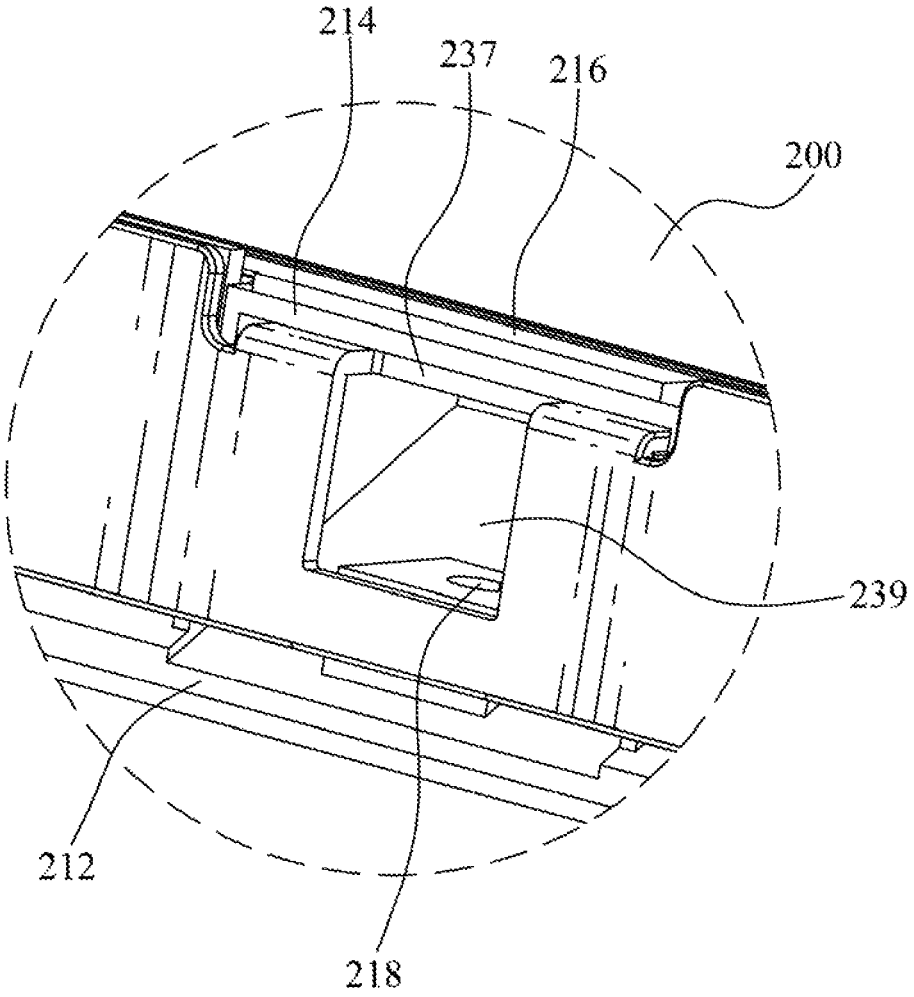
FIG. 4 is an enlarged view of an encircled portion IV of the adapter device of FIG. 3.
Figure 6:
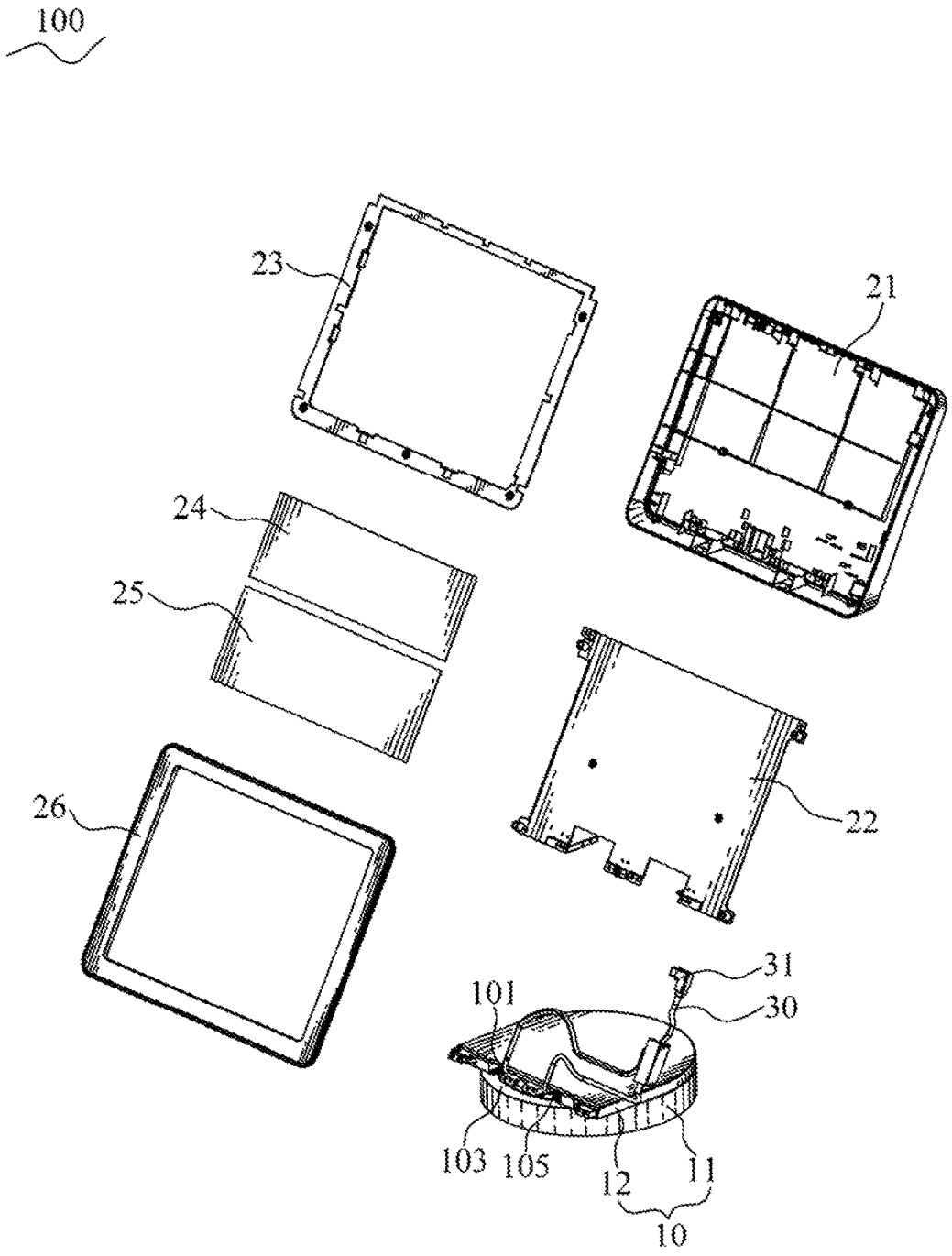
FIG. 6 is an exploded perspective view of the adapter device of FIG. 1.

Referring to FIG. 1, FIG. 2 and FIG. 6, the base body 10 opens a plurality of openings 13 communicated with an inside of the base body 10 and an outside of the base body 10. The inside of the base body 10 defines an accommodating space 101 communicated with the plurality of the openings 13. The circuit board 41 of the circuit module 40 is assembled in the accommodating space 101 of the base body 10. The circuit board 41 is equipped with the plurality of the connection ports 42 with the different specifications. The plurality of the openings 13 are of different shapes and corresponding to the plurality of the connection ports 42 with the different specifications. The plurality of the connection ports 42 are exposed from the plurality of the openings 13. The connection ports 42 with the different specifications are capable of being connected with different docking ports (not shown) of the various electronic devices which have different specifications.

Specifically, the base body 10 includes a base portion 11, and a connecting portion 12 fastened on the base portion 11. A front of the base portion 11 is located under the fastening assembly 20. A rear of the base portion 11 and the connecting portion 12 are located behind the fastening assembly 20. A direction from the front of the base portion 11 to the rear of the base portion 11 is defined as a front-to-rear direction of the adapter device 100. The base portion 11 is of a cylinder shape. The base portion 11 has a bottom surface 102, a top surface 103 opposite to the bottom surface 102, and a peripheral surface 104 connected between peripheries of the bottom surface 102 and the top surface 103. A rear of the bottom surface 102 of the base portion 11 opens a lacking groove 111 penetrating through a lower portion of the peripheral surface 104 of the base portion 11. The plurality of the openings 13 are opened in a front wall of the lacking groove 111. The base portion 11 is of a hollow shape. So an inside of the base portion 11 defines a first accommodating space (not labeled) communicated with the plurality of the openings 13. The circuit board 41 is assembled in the first accommodating space. The connecting portion 12 is fastened to the top surface 103 of the base portion 11. An inside of the connecting portion 12 defines a second accommodating space 105 communicated with the first accommodating space. The accommodating space 101 includes the first accommodating space and the second accommodating space 105.

Referring to FIG. 1, FIG. 2, FIG. 3 and FIG. 6, the fastening assembly 20 is mounted to the connecting portion 12 of the base body 10. The fastening assembly 20 opens the receiving space 220 penetrating through a middle of a front surface of the fastening assembly 20. The tablet electronic device 200 is assembled in the receiving space 220. The fastening assembly 20 includes a rear cover 21, a fastening board 22, a fastening frame 23, a heatsink 24, an isolating gasket 25 and a front cover 26.

Figure 7:
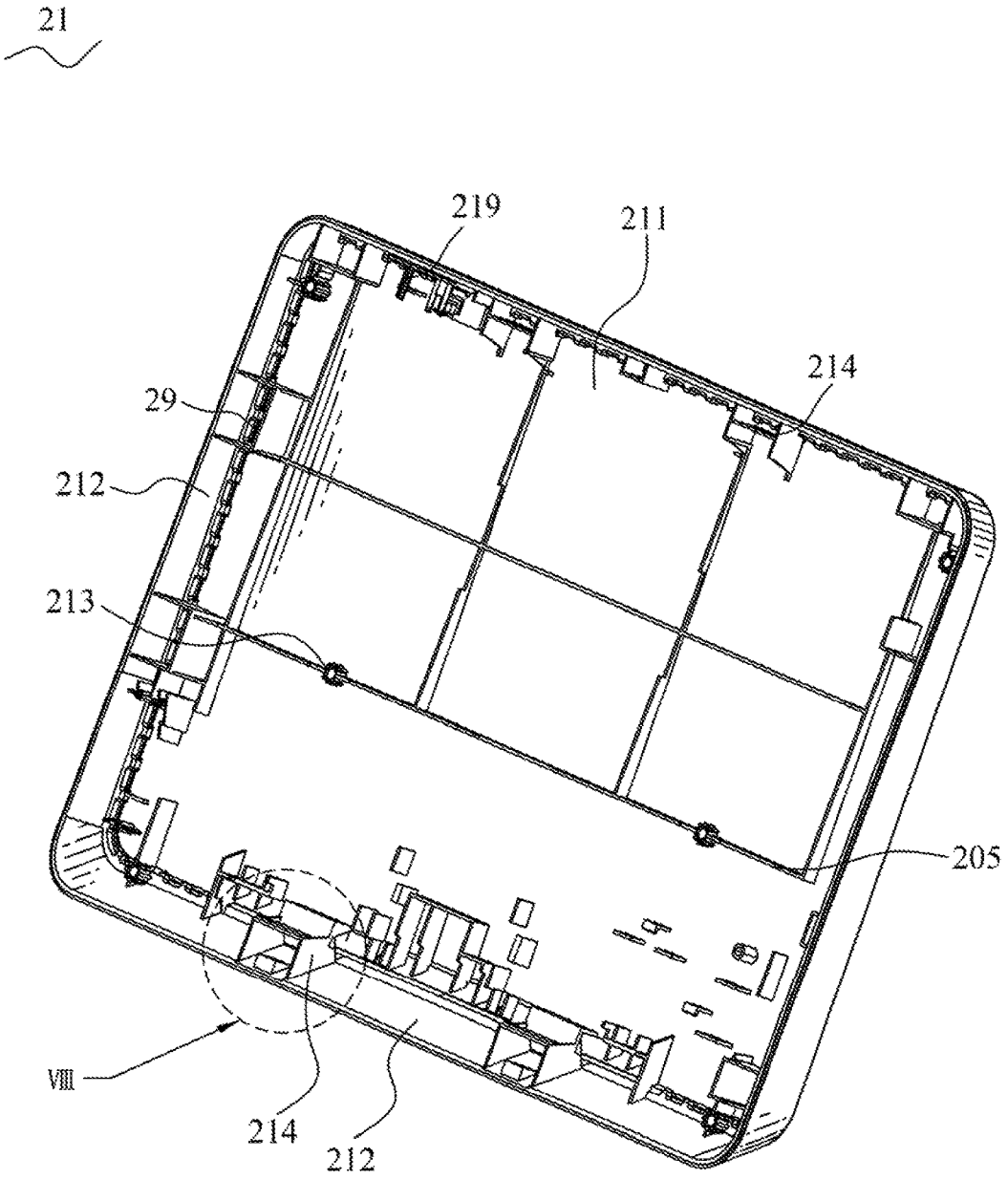
FIG. 7 is a perspective view of a rear cover of the adapter device of FIG. 1.
Figure 8:
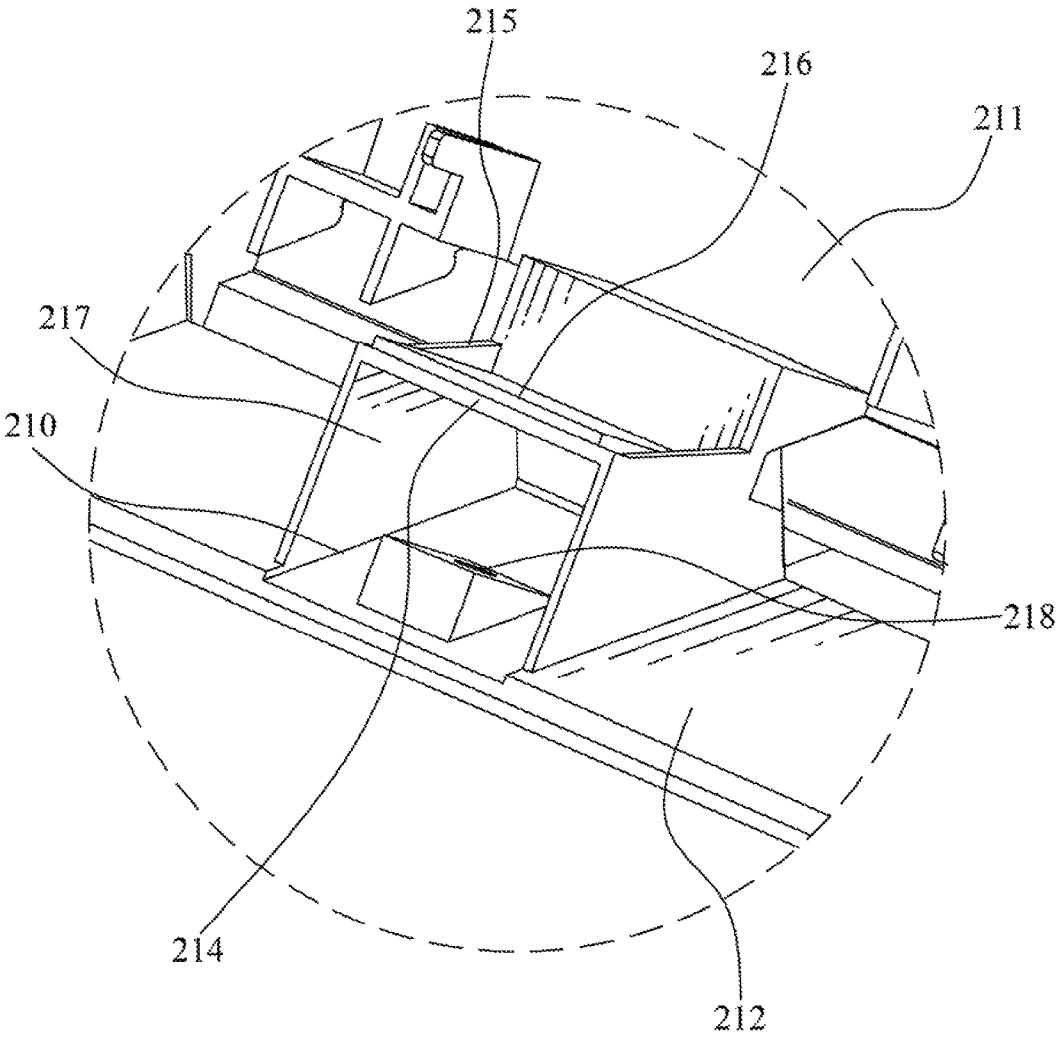
FIG. 8 is an enlarged view of an encircled portion VIII of the rear cover of the adapter device of FIG. 7.

Referring to FIG. 6 to FIG. 8, the rear cover 21 includes a rectangular rear board 211, and four side boards 212 protruded frontward from a periphery of a front surface of the rear board 211 and interconnected end-to-end to form a rectangular frame. Several portions of the front surface of the rear board 211 of the rear cover 21 protrude frontward to form a plurality of protruding pillars 213. Several portions of the front surface of the rear board 211 of the rear cover 21 protrude frontward to form a plurality of blocking portions 214. Each of the plurality of the blocking portions 214 is of a hollow shape, so a blocking groove 210 is defined in a middle of each of the plurality of the blocking portions 214. Each of the plurality of the blocking portions 214 projects beyond each of the plurality of the protruding pillars 213 to form a segment gap between each of front surfaces of the plurality of the protruding pillars 213 and each of front surfaces of the plurality of the blocking portions 214. The plurality of the blocking portions 214 are connected with inner surfaces of the four side boards 212 and the front surface of the rear board 211. Several portions of the front surface of the rear board 211 protrude frontward to form a plurality of supporting ribs 205 among the plurality of the blocking portions 214.

Referring to FIG. 3, FIG. 6, FIG. 7, FIG. 9 and FIG. 10, the fastening board 22 is fastened to the rear board 211. A rear surface of the fastening board 22 faces the front surface of the rear board 211. The fastening board 22 is fastened to the front surfaces of the plurality of the protruding pillars 213 and is surrounded among the plurality of the blocking portions 214. The fastening board 22 is supported by the plurality of the supporting ribs 205, so the rear surface of the fastening board 22 is spaced from the front surface of the rear board 211. A rear receiving space 27 is formed among the fastening board 22, the rear board 211 and rears of the four side boards 212. The fastening frame 23 is assembled in the rear cover 21 and is fastened to a front of the fastening board 22. A rear surface of the fastening frame 23 is spaced from a middle of a front surface of the fastening board 22. Correspondingly, a front receiving space 28 is surrounded among the fastening board 22, the fastening frame 23 and fronts of the four side boards 212 of the rear cover 21. So the receiving space 220 is divided into the rear receiving space 27 and the front receiving space 28 by the fastening board 22.

Referring to FIG. 2, FIG. 3, FIG. 5, FIG. 7 and FIG. 10, the tablet electronic device 200 is received in the front receiving space 28, and is fastened between the fastening board 22 and the fastening frame 23. The power switch 202 is disposed to a top face 204 of the tablet electronic device 200 opposite to the bottom surface 102 of the base portion 11. The at least one insertion port 201 is disposed to a side face 203 of the tablet electronic device 200 connected with the top face 204 of the tablet electronic device 200. Specifically, the tablet electronic device 200 is a tablet computer. The tablet electronic device 200 are equipped with a plurality of insertion ports 201. The plurality of the insertion ports 201 are disposed to the side face 203 of the tablet electronic device 200 connected with the top face 204 of the tablet electronic device 200. One side of the receiving space 220 is defined as a plug receiving space 50. The plug receiving space 50 is surrounded among one side surface of the fastening board 22 adjacent to the at least one insertion port 201, one side of the front surface of the rear board 211 adjacent to the at least one insertion port 201, two of the plurality of the blocking portions 214 facing to the side face 203 of the tablet electronic device 200, the inner surface of one of the four side boards 212 facing to the side face 203 of the tablet electronic device 200, and one side of the fastening frame 23 adjacent to the at least one insertion port 201.

Referring to FIG. 4, FIG. 5, FIG. 7, FIG. 8, FIG. 10 and FIG. 15, each of inner surfaces of the plurality of the blocking portions 214 protrudes inward towards the tablet electronic device 200 to form an abutting rib 215. An inner surface of the abutting rib 215 cooperates with a peripheral face 207 of the tablet electronic device 200. The tablet electronic device 200 is blocked among the inner surfaces of the plurality of the blocking portions 214. Specifically, two opposite sides of each of the inner surfaces of the plurality of the blocking portions 214 cooperating with the peripheral face 207 of the tablet electronic device 200 protrude inward towards the tablet electronic device 200 to form two abutting ribs 215 spaced from each other. A middle of each of the blocking portions 214 facing to a bottom face 208 of the tablet electronic device 200 is equipped with an anti-skid gasket 216 located between the two abutting ribs 215. The bottom face 208 of the tablet electronic device 200 is opposite to the top face 204 of the tablet electronic device 200. The peripheral face 207 of the tablet electronic device 200 includes the top face 204, the bottom face 208 and the side face 203 of the tablet electronic device 200.

The anti-skid gasket 216 abuts against the bottom face 208 of the tablet electronic device 200. The anti-skid gasket 216 has a shock absorption function, and is capable of preventing the tablet electronic device 200 from sliding. Each of the plurality of the blocking portions 214 has a reinforcing rib 217. The reinforcing ribs 217 of the plurality of the blocking portions 214 are connected with the inner surfaces of the four side boards 212 and the front surface of the rear board 211. Specifically, the two of the plurality of the blocking portions 214 facing to the side face 203 of the tablet electronic device 200 has one reinforcing rib 217 connected with the inner surface of the one of the four side boards 212 facing to the side face 203 of the tablet electronic device 200 and the front surface of the rear board 211. Two opposite sides of each of the other blocking portions 214 have two reinforcing ribs 217 connected with the inner surfaces of the other side boards 212 and the front surface of the rear board 211. The one of the four side boards 212 facing to the side face 203 of the tablet electronic device 200 to which the at least one insertion port 201 is disposed opens a lower fastening hole 218. The one of the four side boards 212 facing to the side face 203 of the tablet electronic device 200 opens two lower fastening holes 218 arranged transversely. The two lower fastening holes 218 are opened in the two of the plurality of the blocking portions 214 facing to the side face 203 of the tablet electronic device 200. The rear board 211 of the rear cover 21 opens a plurality of dissipating holes 29 communicated with the receiving space 220.

Referring to FIG. 1, FIG. 3, FIG. 5 and FIG. 7, the fastening assembly 20 has a button 219 corresponding to and contacting with the power switch 202 of the tablet electronic device 200. The button 219 is capable of making the power switch 202 turned on or turned off. Specifically, one of the four side boards 212 of which the inner surface faces to the top face 204 of the tablet electronic device 200 is equipped with the button 219 corresponding to and contacting with the power switch 202 of the tablet electronic device 200.

Figure 9:
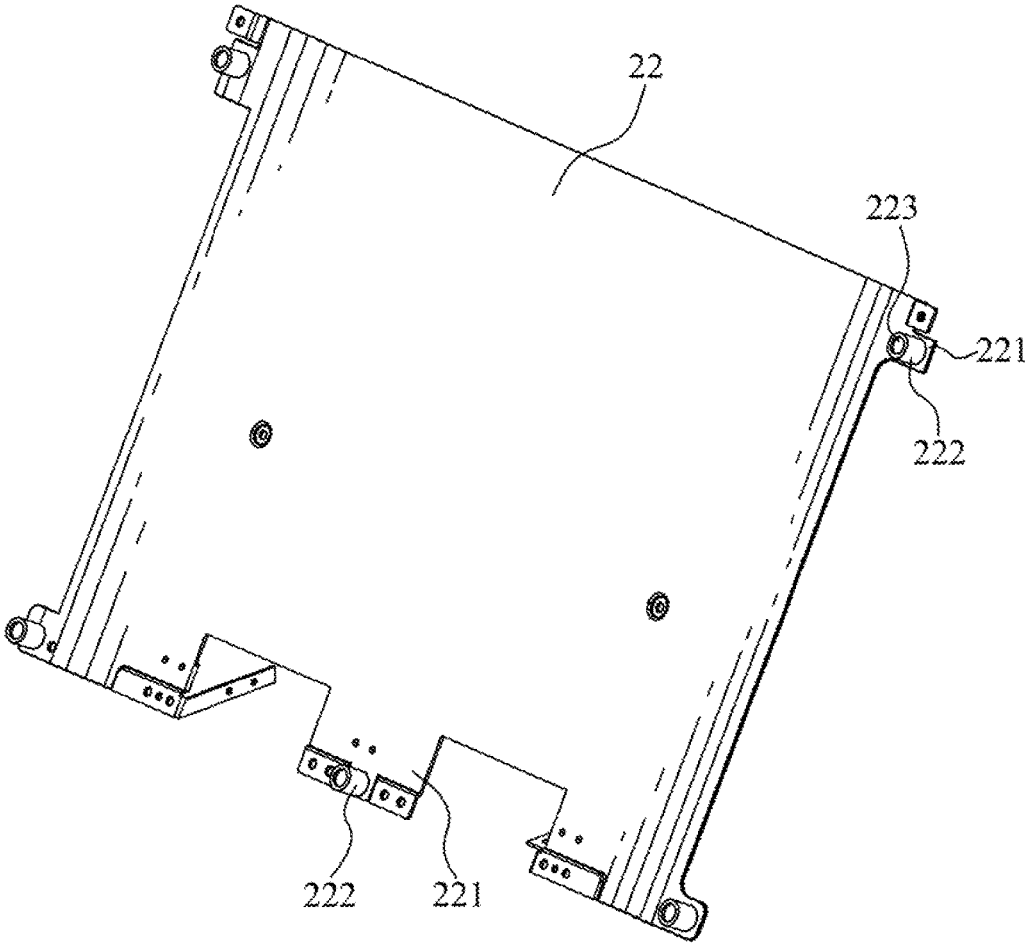
FIG. 9 is a perspective view of a fastening board of the adapter device of FIG. 1.
Figure 10:
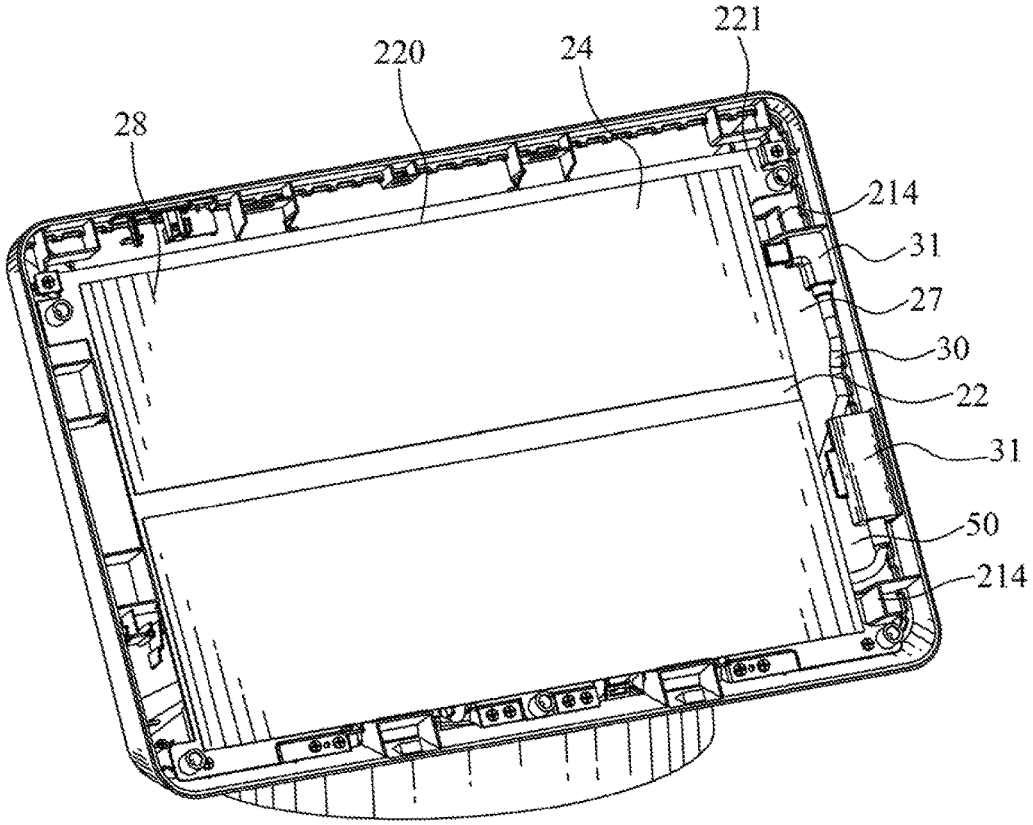
FIG. 10 is another partially perspective view of the adapter device of FIG. 1, wherein a fastening frame and the front cover of the adapter device are omitted.
Figure 11:
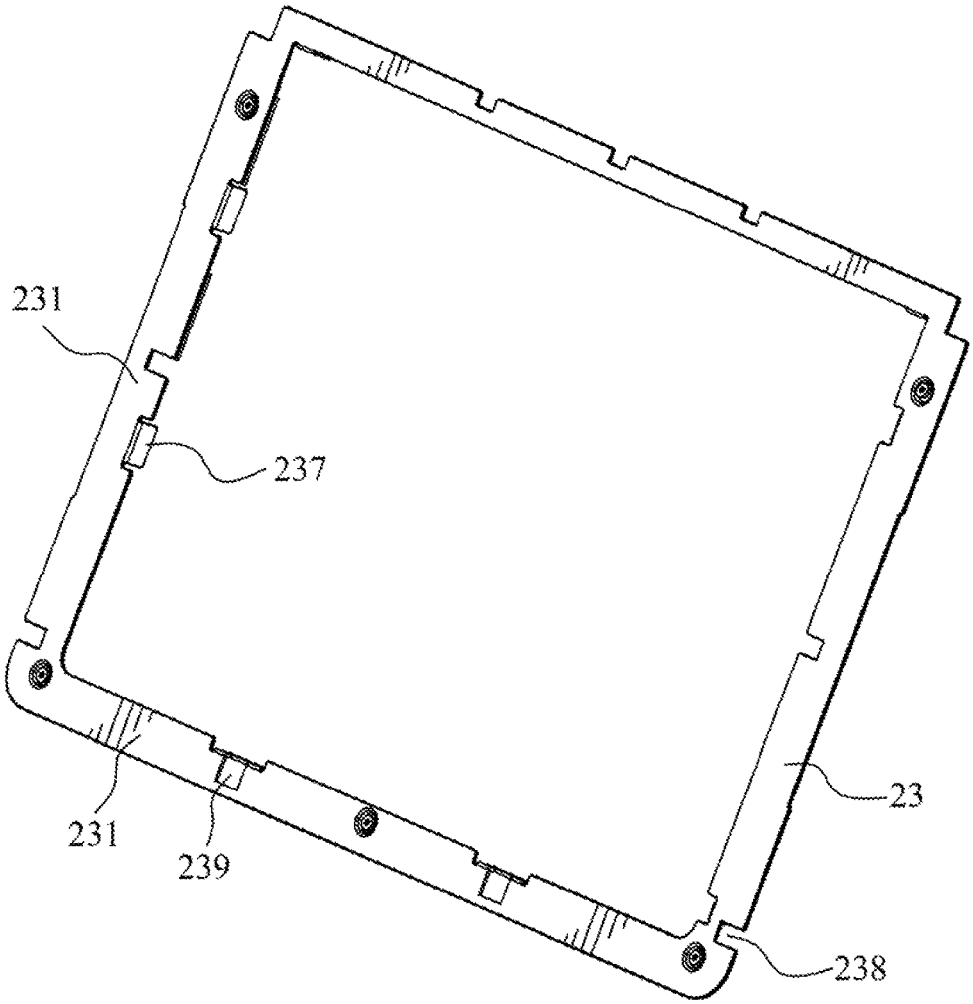
FIG. 11 is a perspective view of the fastening frame of the adapter device of FIG. 1.
Figure 12:
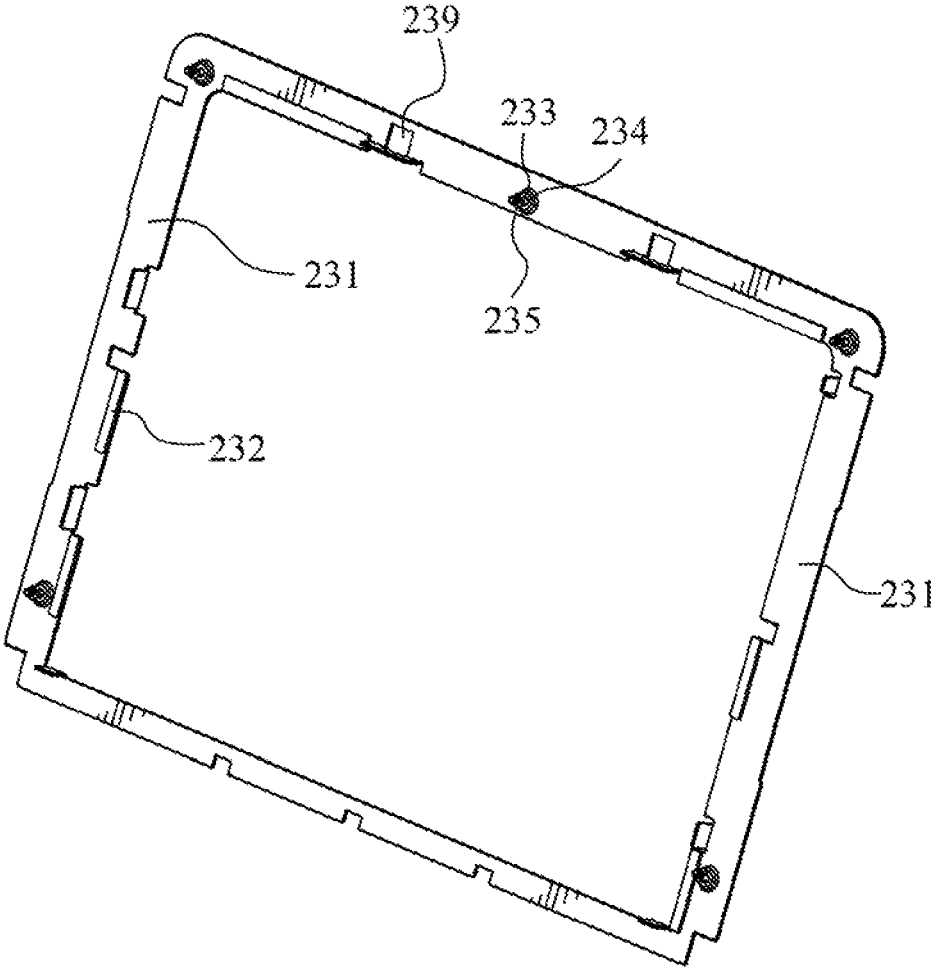
FIG. 12 is another perspective view of the fastening frame of the adapter device of FIG. 11.
Figure 13:
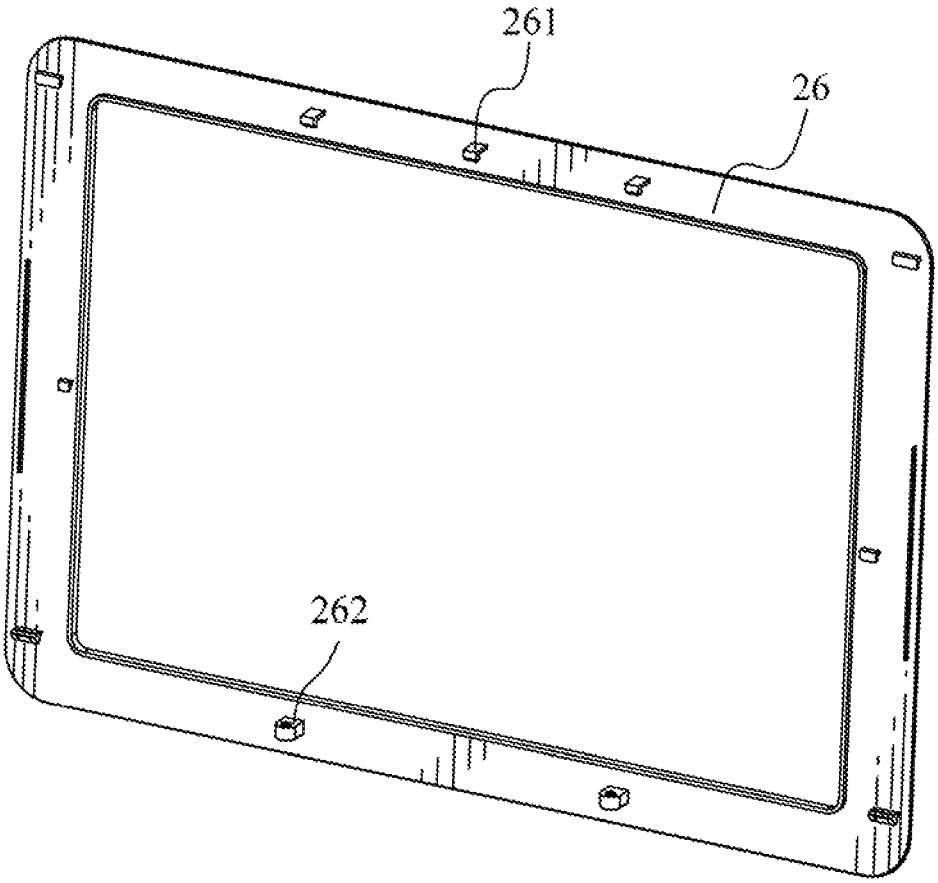
FIG. 13 is a perspective view of the front cover of the adapter device of FIG. 1.
Figure 14:
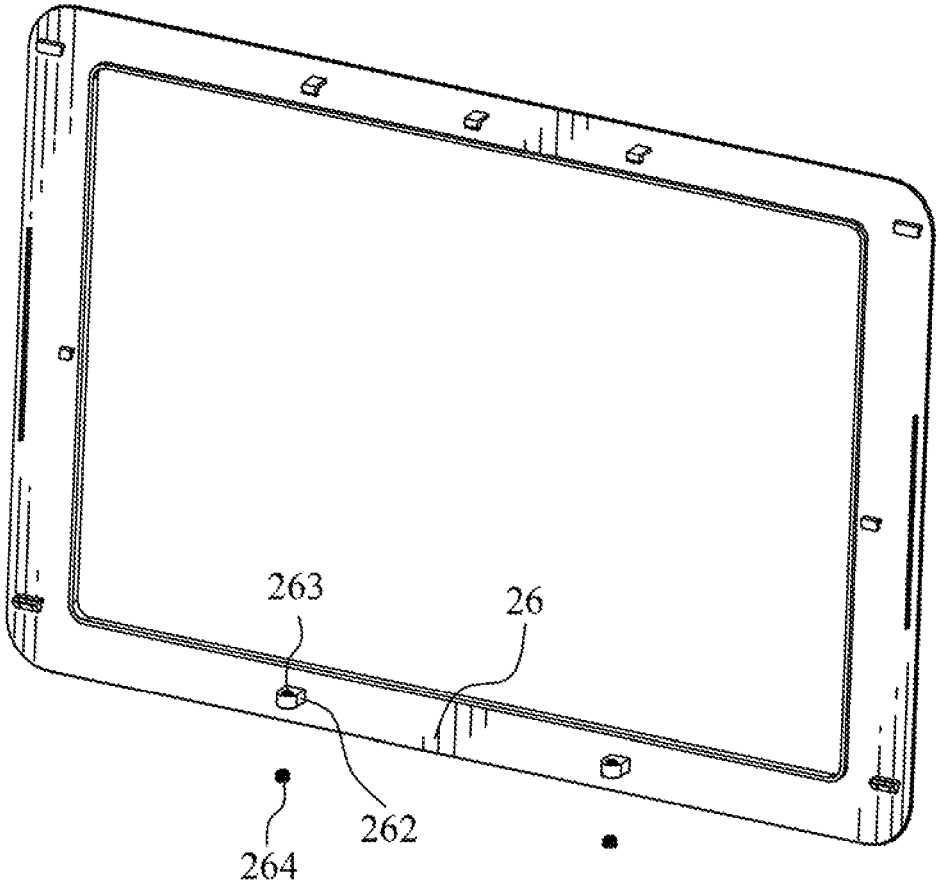
FIG. 14 is an exploded perspective view of the front cover of the adapter device of FIG. 13.
Figure 15:
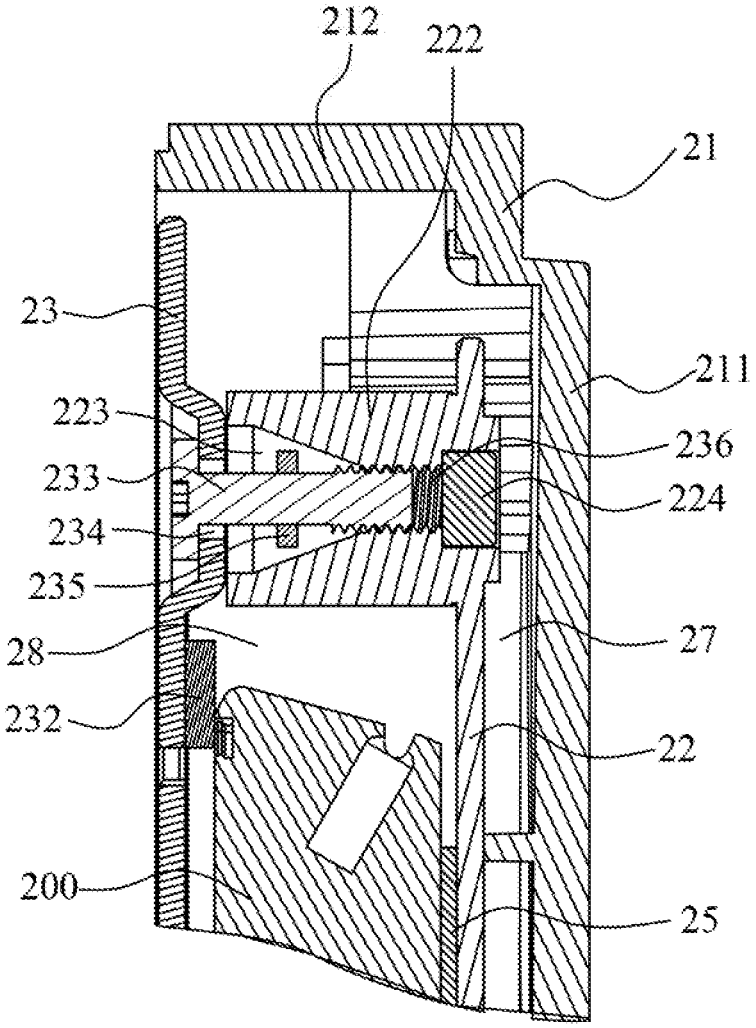
FIG. 15 is a partially sectional diagrammatic drawing of the adapter device of FIG. 1, wherein the tablet electronic device is assembled in the front receiving space of the adapter device, and the front cover of the adapter device is omitted.

Referring to FIG. 9, FIG. 10 and FIG. 15, several portions of a periphery of the fastening board 22 protrude outward to form a plurality of protruding ears 221. Each of the plurality of the protruding ears 221 is located among the four side boards 212 of the rear cover 21 and projects into an interval among the plurality of the blocking portions 214. A front surface of each of the plurality of the protruding ears 221 protrudes frontward to form a fastening pillar 222. The fastening pillar 222 opens a funnel-shaped countersunk screw hole 223 penetrating through a middle of a front surface of the fastening pillar 222. A rear end of the fastening pillar 222 is equipped with a magnet 224 fastened in a rear of the countersunk screw hole 223.

Referring to FIG. 5, FIG. 9, FIG. 11, FIG. 12 and FIG. 15, the fastening frame 23 is surrounded by four base boards 231 which are connected end-to-end. The fastening frame 23 abuts against a periphery of a front face 209 of the tablet electronic device 200. The front face 209 of the tablet electronic device 200 is connected with fronts of the peripheral face 207 of the tablet electronic device 200. Specifically, the rear surface of the fastening frame 23 is adhered with a plurality of protecting pads 232. The fastening frame 23 abuts against the periphery of the front face 209 of the tablet electronic device 200 by virtue of the protecting pads 232. Each of the protecting pads 232 has a shock absorption function and is capable of preventing scratching the front face 209 of the tablet electronic device 200 when the tablet electronic device 200 and the fastening frame 23 are assembled. The fastening frame 23 are equipped with a plurality of first screws 233. The plurality of the first screws 233 are corresponding to and screwed in the countersunk screw holes 223 of the fastening pillars 222 of the plurality of the protruding ears 221 so as to fasten the fastening frame 23 to the front surface of the fastening pillar 222.

Specifically, the fastening frame 23 opens a plurality of perforations 234 corresponding to the countersunk screw holes 223 of the fastening pillar 222. The first screws 233 are assembled rearward in the perforations 234. A C-shaped clasp 235 is worn around one end of each of the first screws 233 projecting beyond the rear surface of the fastening frame 23 for preventing the first screws 233 falling off in a process of assembling the first screws 233. In a process of the fastening frame 23 being fastened to the fastening board 22, when a droop angle of each of the first screws 233 relative to the countersunk screw hole 223 is overly large, the droop angle of each of the first screws 233 relative to the countersunk screw hole 223 will be affected by the magnet 224 in the countersunk screw hole 223 to automatically correct the droop angle of each of the first screws 233 relative to the countersunk screw hole 223, so that each of the first screws 233 is screwed in the countersunk screw hole 223 quickly. After each of the plurality of the first screws 233 is screwed in the countersunk screw hole 223, the magnet 224 is spaced from each of the plurality of the first screws 233 in the countersunk screw hole 223 to form a cavity 236. In the process of assembling the plurality of the first screws 233, iron chips are generated on account of the plurality of the first screws 233 being rubbed, and the iron chips will be absorbed in the cavity 236 by the magnet 224.

Referring to FIG. 4, FIG. 5, FIG. 8 and FIG. 11, several portions of an inner periphery of the fastening frame 23 are punched rearward to form a plurality of guiding pieces 237 corresponding to the plurality of the blocking portions 214. Each of the guiding pieces 237 is blocked in the blocking groove 210. The two reinforcing ribs 217 of each of the other blocking portions 214 clamp one of the guiding pieces 237. Inner surfaces and outer surfaces of the four base boards 231 of the fastening frame 23 are recessed inward to form a plurality of buckling grooves 238. One of the four base boards 231 corresponding to the one of the four side boards 212 facing to the side face 203 of the tablet electronic device 200 to which the at least one insertion port 201 is disposed opens an assembling hole 239. The assembling hole 239 is corresponding to the lower fastening hole 218. One of the four base boards 231 corresponding to the one of the four side boards 212 facing to the side face 203 of the tablet electronic device 200 opens two assembling holes 239 corresponding to the two lower fastening holes 218.

Figure 5:
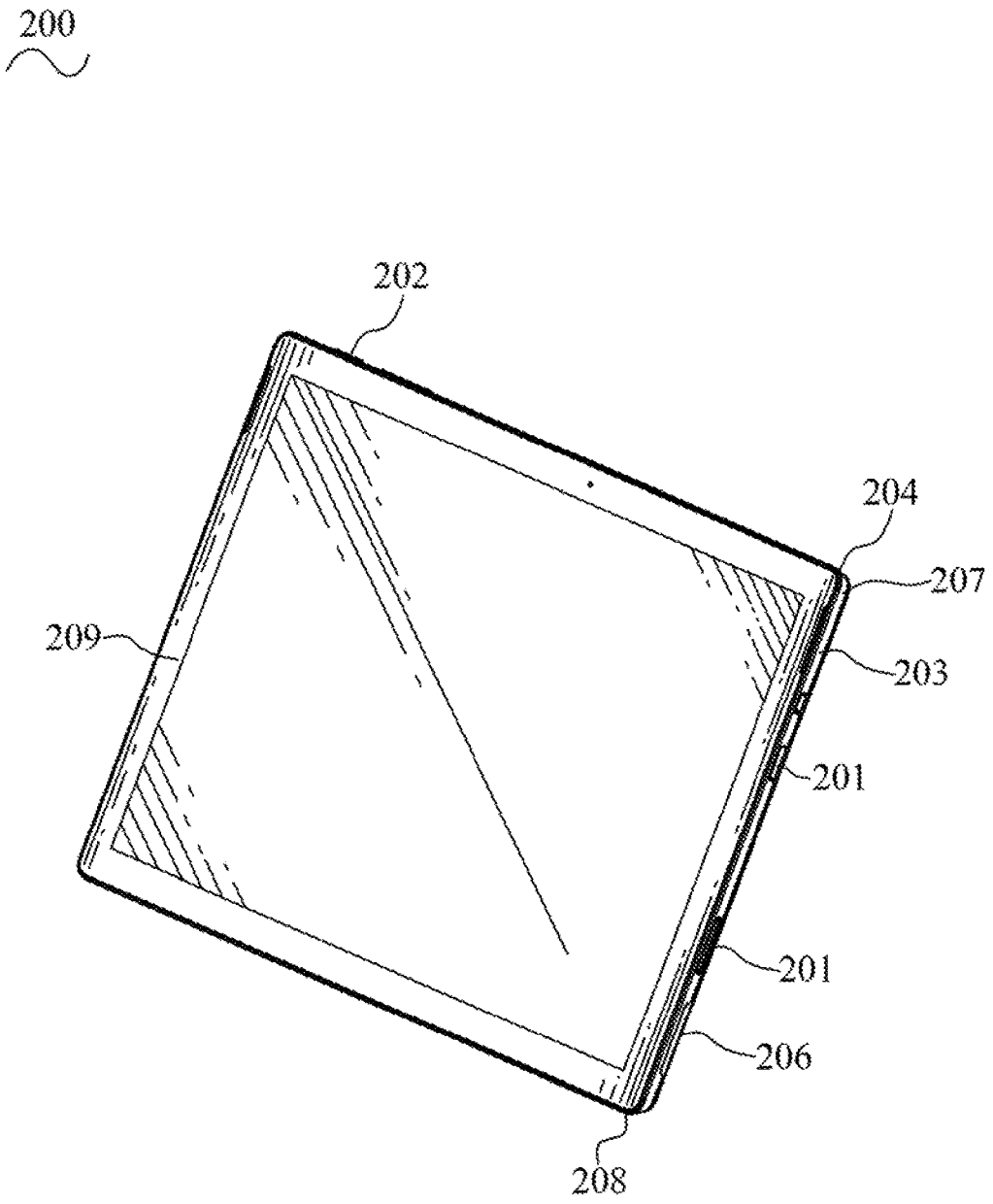
FIG. 5 is a perspective view of the tablet electronic device of FIG. 3.

Referring to FIG. 5, FIG. 6 and FIG. 10, the front surface of the fastening board 22 is equipped with the heatsink 24 and is adhered with the isolating gasket 25. A thickness of the isolating gasket 25 is the same as a thickness of the heatsink 24. A rear face 206 of the tablet electronic device 200 opposite to the front face 209 of the tablet electronic device 200 abuts against the heatsink 24 and the isolating gasket 25. Specifically, in this preferred embodiment, a heat emitting portion of the tablet electronic device 200 is located at an upper portion of the tablet electronic device 200. The heatsink 24 is adhered to an upper portion of the front surface of the fastening board 22 corresponding to the heat emitting portion of the tablet electronic device 200, and the isolating gasket 25 is adhered to a lower portion of the front surface of the fastening board 22. A pressing force of the fastening frame 23 is transmitted by the protecting pads 232 to make the rear face 206 of the tablet electronic device 200 opposite to the front face 209 of the tablet electronic device 200 abut against the heatsink 24 and the isolating gasket 25.

Referring to FIG. 1, FIG. 2, FIG. 4, FIG. 5, FIG. 6, FIG. 8, FIG. 11, FIG. 13 and FIG. 14, the front cover 26 is of a rectangular frame shape. The front cover 26 is fastened to a front surface of the fastening frame 23. Several portions of a rear surface of the front cover 26 protrude rearward to form a plurality of buckling hooks 261 corresponding to the plurality of the buckling grooves 238. The plurality of the buckling hooks 261 are buckled in the plurality of the buckling grooves 238 and hook the rear surface of the fastening frame 23. The rear surface of the front cover 26 is attached to the front surface of the fastening frame 23 tightly. Two opposite sides of a free end of each of the plurality of the buckling hooks 261 are chamfered, and two opposite sides of an inner wall of each of the plurality of the buckling grooves 238 are chamfered, so the plurality of the buckling hooks 261 slide into and are buckled in the plurality of the buckling grooves 238 smoothly. The rear surface of the front cover 26 protrude rearward to form an assembling pillar 262 corresponding to the assembling hole 239. Two sides of the rear surface of the front cover 26 protrude rearward to form two assembling pillars 262 corresponding to the two assembling holes 239, respectively. The assembling pillar 262 opens an upper fastening hole 263 corresponding to the lower fastening hole 218. Each of the two assembling pillars 262 opens the upper fastening hole 263 corresponding to the lower fastening hole 218. A metal nut 264 is assembled in the upper fastening hole 263. The assembling pillar 262 is assembled in the assembling hole 239 and project beyond the rear surface of the fastening board 22. The two assembling pillars 262 are assembled in the two assembling holes 239 and project beyond the rear surface of the fastening board 22. The front cover 26 is locked to the one of the four side boards 212 of the rear cover 21 facing to the side face 203 of the tablet electronic device 200 to which the at least one insertion port 201 is disposed by virtue of a second screw 265 being screwed in the metal nut 264 of the upper fastening hole 263 and the lower fastening hole 218. In this preferred embodiment, two metal nuts 264 are assembled in the upper fastening holes 263 of the two assembling pillars 262. The front cover 26 is locked to the one of the four side boards 212 of the rear cover 21 facing to the side face 203 of the tablet electronic device 200 by virtue of two second screws 265 being screwed in the two metal nuts 264 of the upper fastening holes 263 of the two assembling pillars 262 and the two lower fastening holes 218.

Referring to FIG. 1, FIG. 2, FIG. 5, FIG. 6 and FIG. 10, the at least one connecting cable 30 passes through connecting ends of the base body 10 and the fastening assembly 20, and the at least one connecting cable 30 is received in the accommodating space 101 of the base body 10 and the receiving space 220 of the fastening assembly 20. One end of the at least one connecting cable 30 is electrically connected with the circuit board 41. The other end of the at least one connecting cable 30 is equipped with a plug 31 docking with the at least one insertion port 201 of the tablet electronic device 200. The one end of the at least one connecting cable 30 is received in the accommodating space 101. The other end of the at least one connecting cable 30 is received in the rear receiving space 27. The plug 31 of the at least one connecting cable 30 is received in the one side of the receiving space 220. The plug 31 of the at least one connecting cable 30 is further received in the plug receiving space 50.

In this preferred embodiment, the adapter device 100 includes two connecting cables 30. The two connecting cables 30 pass through the connecting ends of the base body 10 and the fastening assembly 20 and are received in the accommodating space 101 of the base body 10 and the receiving space 220 of the fastening assembly 20. Specifically, the one end of each of the two connecting cables 30 is electrically connected with the circuit board 41. The other end of each of the two connecting cables 30 is equipped with the plug 31 docking with one of the plurality of the insertion ports 201 of the tablet electronic device 200. The one end of each of the two connecting cables 30 connected with the circuit board 41 is received in the accommodating space 101. The other end of each of the two connecting cables 30 is received in the rear receiving space 27. The plug 31 of each of the two connecting cables 30 is received in the one side of the receiving space 220, and is disposed to one side of the fastening board 22. The plug 31 of each of the two connecting cables 30 is further received in the plug receiving space 50.

Referring to FIG. 1, FIG. 3, FIG. 5, FIG. 6 and FIG. 10, a process of assembling the tablet electronic device 200 in the adapter device 100 is described as follows. At first, the front cover 26 and the fastening frame 23 are taken down, and the plug 31 of the at least one connecting cable 30 is inserted into the at least one insertion port 201 of the tablet electronic device 200. Then the tablet electronic device 200 is assembled in the front receiving space 28, and the fastening frame 23 is disposed to the periphery of the front face 209 of the tablet electronic device 200 and is fastened to the fastening board 22. At last, the front cover 26 is fastened to the front surface of the fastening frame 23 and is locked to the rear cover 21. The various electronic devices are electrically connected with the tablet electronic device 200 by virtue of the adapter device 100 being connected between the at least one insertion port 201 of the tablet electronic device 200 and the different docking ports of the various electronic devices.

As described above, the circuit board 41 is equipped with the plurality of the connection ports 42 with the different specifications, the one end of the at least one connecting cable 30 is electrically connected with the circuit board 41, and the other end of the at least one connecting cable 30 is equipped with the plug 31 docking with the at least one insertion port 201 of the tablet electronic device 200, the connection ports 42 with the different specifications are capable of being connected with the different docking ports of the various electronic devices which have the different specifications, and the various electronic devices are electrically connected with the tablet electronic device 200 by virtue of the adapter device 100 being connected between the at least one insertion port 201 of the tablet electronic device 200 and the different docking ports of the various electronic devices, so the tablet electronic device 200 is appropriate for being applied in various usage environments for satisfying multiple usage needs of users. Furthermore, no transmission cable is applied to dock with the different docking ports of the various electronic devices, so no transmission cable need be prepared to bring a convenience in use.

What is claimed is:

1. An adapter device for receiving a tablet electronic device in the adapter device, the adapter device having a plurality of connection ports with different specifications, the tablet electronic device being equipped with at least one insertion port, the adapter device converting the at least one insertion port into the plurality of the connection ports with the different specifications, the adapter device comprising:

a base body opening a plurality of openings communicated with an inside of the base body and an outside of the base body, the plurality of the openings being corresponding to the plurality of the connection ports with the different specifications, the inside of the base body defining an accommodating space communicated with the plurality of the openings;

a fastening assembly mounted to the base body, the fastening assembly opening a receiving space penetrating through a middle of a front surface of the fastening assembly, the tablet electronic device being assembled in the receiving space; and a circuit module assembled to the base body, the circuit module including a circuit board and at least one connecting cable, the circuit board being assembled in the accommodating space of the base body, the circuit board being equipped with the plurality of the connection ports with the different specifications, the plurality of the connection ports being exposed from the plurality of the openings, the at least one connecting cable passing through connecting ends of the base body and the fastening assembly, and the at least one connecting cable being received in the accommodating space of the base body and the receiving space of the fastening assembly, one end of the at least one connecting cable being electrically connected with the circuit board, the other end of the at least one connecting cable being equipped with a plug docking with the at least one insertion port of the tablet electronic device.

2. The adapter device as claimed in claim 1, wherein the fastening assembly includes a rear cover and a fastening board, the rear cover includes a rear board, and four side boards protruded frontward from a periphery of a front surface of the rear board and interconnected end-to-end, the fastening board is fastened to the rear board, a rear surface of the fastening board is spaced from the front surface of the rear board, a rear receiving space is formed among the fastening board, the rear board and rears of the four side boards, the one end of the at least one connecting cable is received in the accommodating space, the other end of the at least one connecting cable is received in the rear receiving space, the plug of the at least one connecting cable is received in one side of the receiving space.

3. The adapter device as claimed in claim 2, wherein the fastening assembly includes a fastening frame surrounded by four base boards which are connected end-to-end, the fastening frame is assembled in the rear cover and is fastened to a front of the fastening board, a rear surface of the fastening frame is spaced from a middle of a front surface of the fastening board, a front receiving space is surrounded among the fastening board, the fastening frame and fronts of the four side boards of the rear cover, so the receiving space is divided into the rear receiving space and the front receiving space by the fastening board, the tablet electronic device is received in the front receiving space, and is fastened between the fastening board and the fastening frame, the fastening frame abuts against a periphery of a front face of the tablet electronic device.

4. The adapter device as claimed in claim 3, wherein the rear surface of the fastening frame is adhered with a plurality of protecting pads, the fastening frame abuts against the periphery of the front face of the tablet electronic device by virtue of the protecting pads.

5. The adapter device as claimed in claim 2, wherein several portions of the front surface of the rear board of the rear cover protrude frontward to form a plurality of protruding pillars, several portions of the front surface of the rear board of the rear cover protrude frontward to form a plurality of blocking portions, each of the plurality of the blocking portions projects beyond each of the plurality of the protruding pillars to form a segment gap between each of front surfaces of the plurality of the protruding pillars and each of front surfaces of the plurality of the blocking portions.

6. The adapter device as claimed in claim 5, wherein several portions of a periphery of the fastening board protrude outward to form a plurality of protruding ears, each of the plurality of the protruding ears is located among the four side boards of the rear cover and projects into an interval among the plurality of the blocking portions, a front surface of each of the plurality of the protruding ears protrudes frontward to form a fastening pillar, the fastening pillar opens a countersunk screw hole penetrating through a middle of a front surface of the fastening pillar, the fastening assembly includes a fastening frame equipped with a plurality of first screws, the plurality of the first screws are corresponding to and screwed in the countersunk screw holes of the fastening pillars of the plurality of the protruding ears so as to fasten the fastening frame to the front surface of the fastening pillar.

7. The adapter device as claimed in claim 6, wherein a rear end of the fastening pillar is equipped with a magnet fastened in a rear of the countersunk screw hole, after each of the plurality of the first screws is screwed in the countersunk screw hole, the magnet is spaced from each of the plurality of the first screws in the countersunk screw hole to form a cavity, in a process of assembling the plurality of the first screws, iron chips are generated on account of the plurality of the first screws being rubbed, and iron chips will be absorbed in the cavity by the magnet.

8. The adapter device as claimed in claim 5, wherein the at least one insertion port is disposed to a side face of the tablet electronic device, the fastening board is fastened to the front surfaces of the plurality of the protruding pillars and is surrounded among the plurality of the blocking portions, one side of the receiving space is defined as a plug receiving space which is surrounded among one side surface of the fastening board adjacent to the at least one insertion port, one side of the front surface of the rear board adjacent to the at least one insertion port, two of the plurality of the blocking portions facing to the side face of the tablet electronic device, an inner surface of one of the four side boards facing to the side face of the tablet electronic device, and one side of the fastening frame adjacent to the at least one insertion port, the tablet electronic device is blocked among inner surfaces of the plurality of the blocking portions, the plug of the at least one connecting cable is further received in the plug receiving space.

9. The adapter device as claimed in claim 8, wherein each of the inner surfaces of the plurality of the blocking portions protrudes inward towards the tablet electronic device to form an abutting rib, an inner surface of the abutting rib cooperates with a peripheral face of the tablet electronic device.

10. The adapter device as claimed in claim 8, wherein two opposite sides of each of the inner surfaces of the plurality of the blocking portions cooperating with a peripheral face of the tablet electronic device protrude inward towards the tablet electronic device to form two abutting ribs spaced from each other, a middle of each of the blocking portions facing to a bottom face of the tablet electronic device is equipped with an anti-skid gasket located between the two abutting ribs.

11. The adapter device as claimed in claim 5, wherein each of the plurality of the blocking portions has a reinforcing rib, the reinforcing ribs of the plurality of the blocking portions are connected with inner surfaces of the four side boards and the front surface of the rear board.

12. The adapter device as claimed in claim 5, wherein each of the plurality of the blocking portions is of a hollow shape, so a blocking groove is defined in a middle of each of the plurality of the blocking portions, the fastening assembly includes a fastening frame, several portions of an inner periphery of the fastening frame are punched rearward to form a plurality of guiding pieces corresponding to the plurality of the blocking portions, each of the guiding pieces is blocked in the blocking groove.

13. The adapter device as claimed in claim 1, wherein the fastening assembly includes a fastening frame, and a front cover of a frame shape, the front cover is fastened to a front surface of the fastening frame.

14. The adapter device as claimed in claim 13, wherein inner surfaces and outer surfaces of four base boards of the fastening frame are recessed inward to form a plurality of buckling grooves, several portions of a rear surface of the front cover protrude rearward to form a plurality of buckling hooks corresponding to the plurality of the buckling grooves, the plurality of the buckling hooks are buckled in the plurality of the buckling grooves and hook a rear surface of the fastening frame.

15. The adapter device as claimed in claim 14, wherein two opposite sides of a free end of each of the plurality of the buckling hooks are chamfered, and two opposite sides of an inner wall of each of the plurality of the buckling grooves are chamfered, so the plurality of the buckling hooks slide into and are buckled in the plurality of the buckling grooves smoothly.

16. The adapter device as claimed in claim 14, wherein the fastening assembly includes a fastening board, and a rear cover which includes a rear board, and four side boards protruded frontward from a periphery of a front surface of the rear board and interconnected end-to-end, the fastening board is fastened to the rear board, one of the four base boards corresponding to one of the four side boards facing to the side face of the tablet electronic device to which the at least one insertion port is disposed opens an assembling hole, the assembling pillar is assembled in the assembling hole and project beyond a rear surface of the fastening board.

17. The adapter device as claimed in claim 16, wherein one of the four side boards facing to the side face of the tablet electronic device to which the at least one insertion port is disposed opens a lower fastening hole, the assembling hole is corresponding to the lower fastening hole, the rear surface of the front cover protrude rearward to form an assembling pillar corresponding to the assembling hole, the assembling pillar opens an upper fastening hole corresponding to the lower fastening hole, the front cover is locked to the one of the four side boards of the rear cover facing to the side face of the tablet electronic device to which the at least one insertion port is disposed by virtue of a second screw being screwed in the upper fastening hole and the lower fastening hole.

18. The adapter device as claimed in claim 1, wherein the fastening assembly includes a rear cover which includes a rear board, and a fastening board fastened to the rear board, the fastening assembly includes a heatsink adhered to an upper portion of a front surface of the fastening board, and an isolating gasket adhered to a lower portion of the front surface of the fastening board, a thickness of the isolating gasket is the same as a thickness of the heatsink, the rear board of the rear cover opens a plurality of dissipating holes communicated with the receiving space, a rear face of the tablet electronic device opposite to a front face of the tablet electronic device abuts against the heatsink and the isolating gasket.

19. The adapter device as claimed in claim 1, wherein the tablet electronic device is equipped with a power switch, the fastening assembly has a button corresponding to and contacting with the power switch, the button is capable of making the power switch turned on or turned off.

* * * * *